US007438528B2

(12) United States Patent
Goodman et al.

(10) Patent No.: US 7,438,528 B2
(45) Date of Patent: Oct. 21, 2008

(54) COMPONENT HAVING A COOLING ARRANGEMENT

(75) Inventors: Peter J. Goodman, Bristol (GB); Keith C. Sadler, Bristol (GB); Michiel Kopmels, Bristol (GB)

(73) Assignee: Rolls-Royce PLC, London (GB)

( * ) Notice: Subject to any disclaimer, the term of this patent is extended or adjusted under 35 U.S.C. 154(b) by 500 days.

(21) Appl. No.: 11/199,180

(22) Filed: Aug. 9, 2005

(65) Prior Publication Data

US 2006/0039787 A1 Feb. 23, 2006

(30) Foreign Application Priority Data

Aug. 21, 2004 (GB) ..... 0418743.1

(51) Int. Cl.
*F01D 5/18* (2006.01)

(52) U.S. Cl. ..... 416/97 R

(58) Field of Classification Search ..... None
See application file for complete search history.

(56) References Cited

U.S. PATENT DOCUMENTS 3,819,295 A 6/1974 Hauser et al.
4,203,706 A * 5/1980 Hess ..... 416/97 A
5,326,224 A 7/1994 Lee et al.
5,403,158 A * 4/1995 Auxier ..... 416/97 R
5,496,151 A * 3/1996 Coudray et al. ..... 416/97 R
5,498,133 A * 3/1996 Lee ..... 416/97 R
5,511,946 A 4/1996 Lee et al.
6,325,593 B1 * 12/2001 Darkins et al. ..... 415/115
6,422,819 B1 * 7/2002 Tsai et al. ..... 416/97 R

* cited by examiner

*Primary Examiner*—Richard Edgar
(74) *Attorney, Agent, or Firm*—Oliff & Berridge, PLC

(57) ABSTRACT

A component such as a turbine blade for a gas turbine engine has a cooling arrangement comprising a supply passage 18 within the blade from which extend cooling passages 28 of a first array which open at discharge openings 29, for example at a trailing edge of the blade. Cooling passages 30 of a second array extend into the blade from discharge openings 31, and intersect the passages 28. The passages 30 terminate short of the supply passage 18. As a result of this arrangement, the limiting flow area for cooling air is defined by the cooling passages 28 of the first array, and is not affected by the accuracy with which the cooling passages 30 of the second array intersect the cooling passages 28 of the first array.

18 Claims, 5 Drawing Sheets

COMPONENT HAVING A COOLING ARRANGEMENT

Figure 1A:
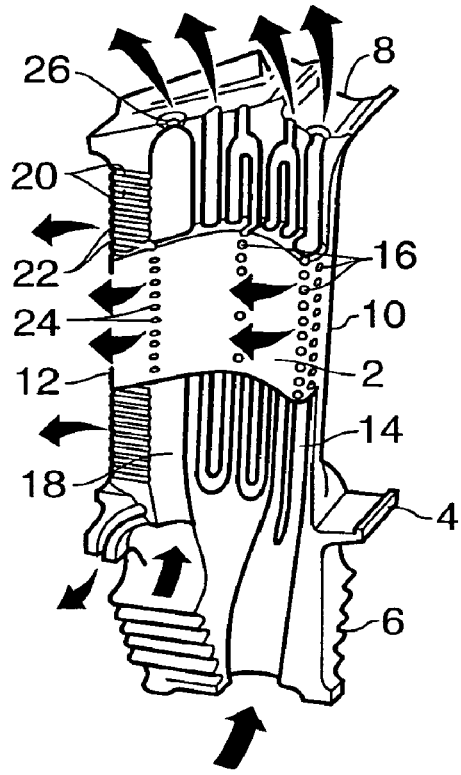

This arrangement relates to a component having a cooling arrangement, and is particularly, although not exclusively, concerned with an airfoil component, such as a turbine blade, for a gas turbine engine.

The gas flow over the components of a turbine stage in a gas turbine engine is often at a temperature which exceeds the melting point of the materials from which the components are made. Measures are therefore taken to cool these components, for example by feeding air from the compressor stage of the engine to interior passageways within the components, the air emerging at openings in the surface of the components to form a film of cooler air to protect the components from the hot gases.

U.S. Pat. No. 3,819,295 discloses a turbine blade having a supply passage for cooling air and two sets of cooling passages which extend from the supply passage to the exterior of the blade. Cooling passages of one set extend obliquely to and intersect the cooling passages of the other set. A problem with a cooling arrangement of this kind is that the resistance to air flow through the cooling passages can vary widely depending on how accurately the cooling passages are aligned. The minimum resistance to air flow, and consequently the maximum flow of cooling air through the cooling passages is achieved when the cooling passages only just intersect. As the distance between the centrelines of intersecting cooling passages decreases, so the overall flow cross-sections become smaller, reducing the air flow rate through the cooling passages. Since the cooling passages are of very small diameter, it is very difficult to achieve sufficient manufacturing accuracy to achieve strictly coplanar sets of cooling passages. Consequently, the cooling air flow rate through the cooling passages is unpredictable, and can vary significantly from blade to blade.

According to the present invention there is provided a component for a gas turbine engine having a cooling arrangement comprising:

- a supply passage within the component;
- a plurality of cooling passages which open at respective discharge openings at a surface of the component,
- a first region of the component adjacent the supply passage that is provided with a first array of cooling passages which lie in a common plane, each cooling passage of the first array opening into the supply passage at its end away from its discharge opening, and
- a second region of the component extending from the first region to the discharge openings comprising a second array of cooling passages which lie in a common plane and the first array of cooling passages,
- each of the cooling passages of the second array intersect at least one of the cooling passages of the first array, each of the cooling passages of the second array terminating short of the supply passage at its end away from its discharge opening at an intersection with at least one of the cooling passages of the first array.

As a result of this arrangement, all air entering the cooling passages from the supply passage flows first through the cooling passages of the first array before encountering intersections with the cooling passages of the second array. A result of this is that the portions of the cooling passages of the first array nearest the supply passage provide the greater part of the restriction to flow of the cooling air from the supply passage to the discharge openings. The flow restriction is dependent on the diameter of each cooling passage, and this can be achieved with accuracy, so providing a predictable flow rate of cooling air.

In this specification, references to the cooling passages of the first and second arrays being in a common plane are not restricted to embodiments in which the common planes are flat. The planes may be curved about one or more axes, particularly if the component is an airfoil which may, for example, have a tangential lean in the radially outwards direction.

The common planes of the first and second arrays may be coincident, but in some embodiments they are displaced from one another, for example they may be parallel to each other or inclined to each other.

If the component is an airfoil component, such as a turbine blade of a gas turbine engine, the discharge openings of the cooling passages of at least one of the arrays may be situated at the trailing edge of the blade. Alternatively, the discharge openings of the cooling passages of at least one of the arrays may be positioned away from the trailing edge, for example on the pressure face of the blade.

The cooling passages of each array may be parallel to each other. The cooling passages of the first array may be inclined by, for example, 30° to 60° to the trailing edge of the blade, and those of the second array may be inclined at, for example, 90° to 150°, for example 120° to 150°, to the trailing edge.

In a preferred embodiment, the cooling passages of the second array terminate at a distance from their discharge openings, measured perpendicular to the trailing edge of the blade, which is not less than ½ and not more than ¾ of the total distance between the discharge openings of those coolant passages and the supply passage.

Each cooling passage of the second array may intersect only one coolant passage of the first array but in some embodiments the coolant passages of the second array intersect at least three cooling passages of the first array.

Figure 1B:
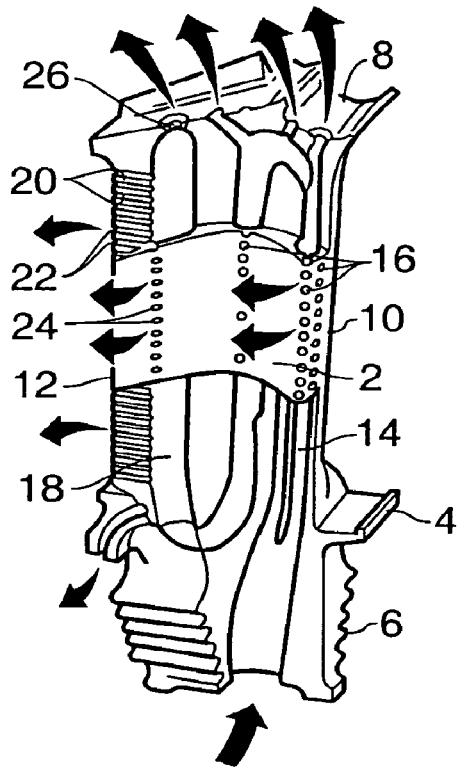
Figure 2:
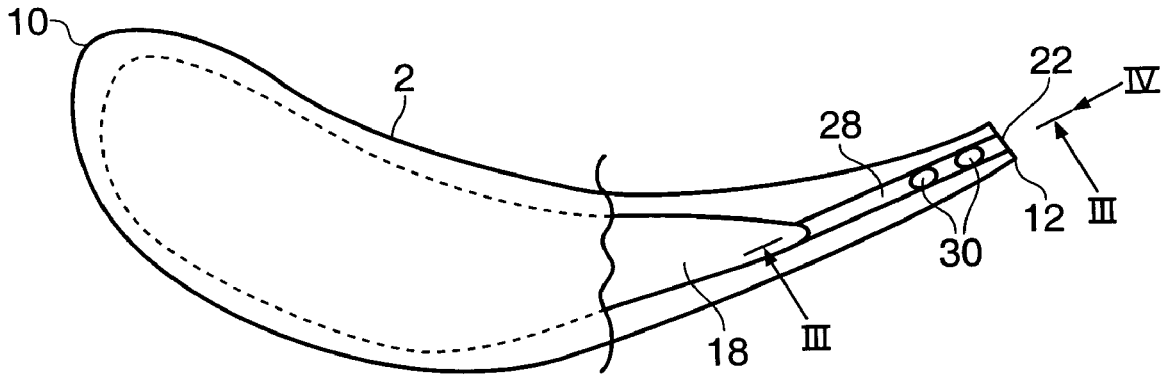
Figure 3:
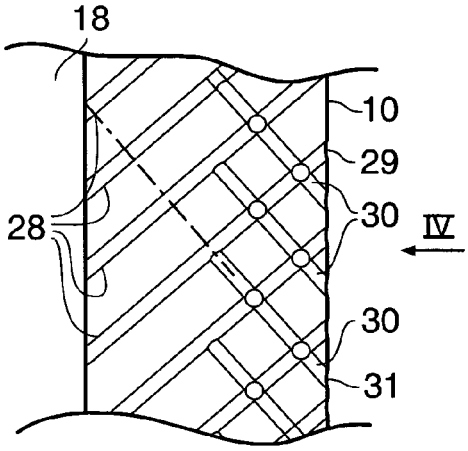
Figure 4:
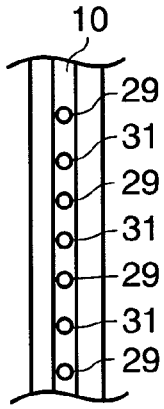
Figure 5:
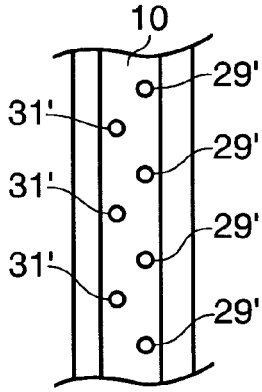
Figure 6:
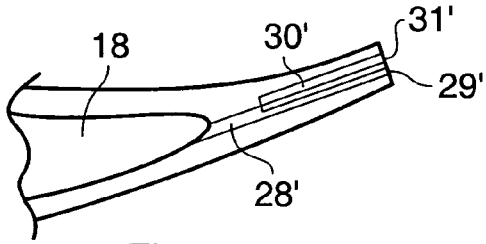
Figure 7:
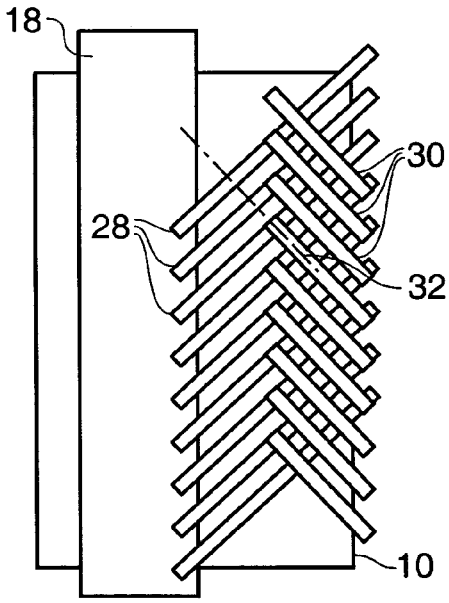
Figure 8:
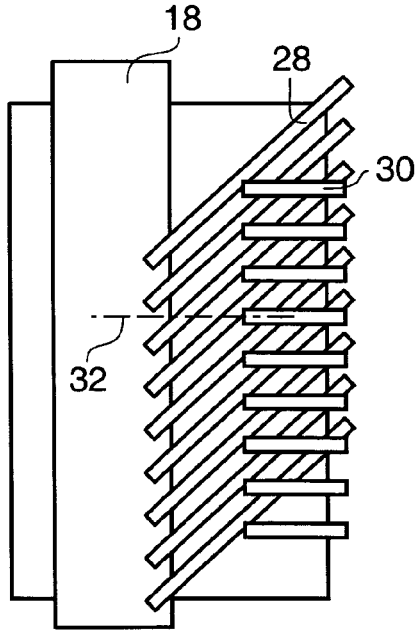
Figure 9:
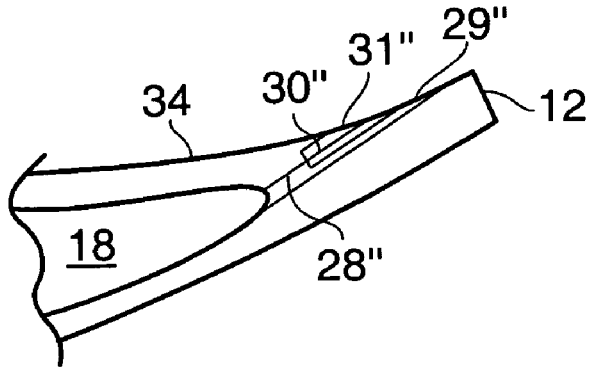
Figure 10:
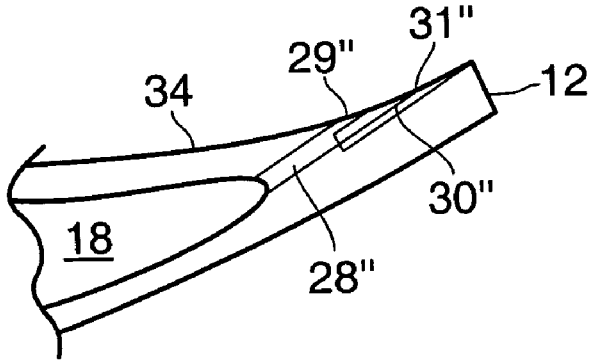
Figure 11:
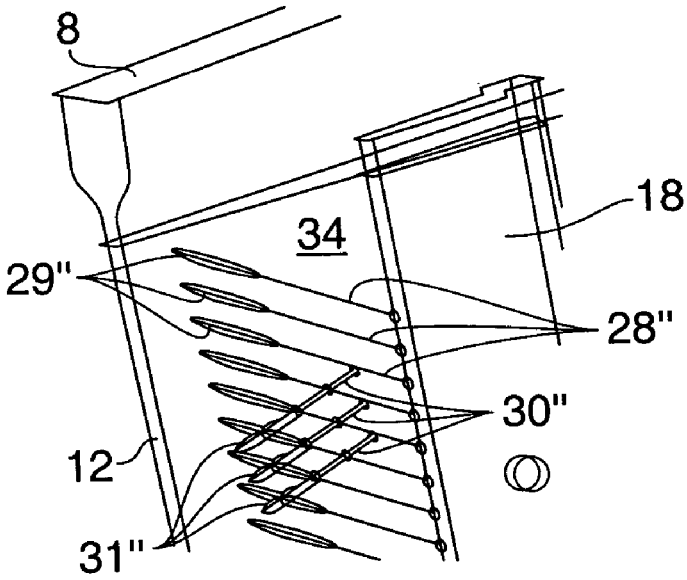
Figure 12:
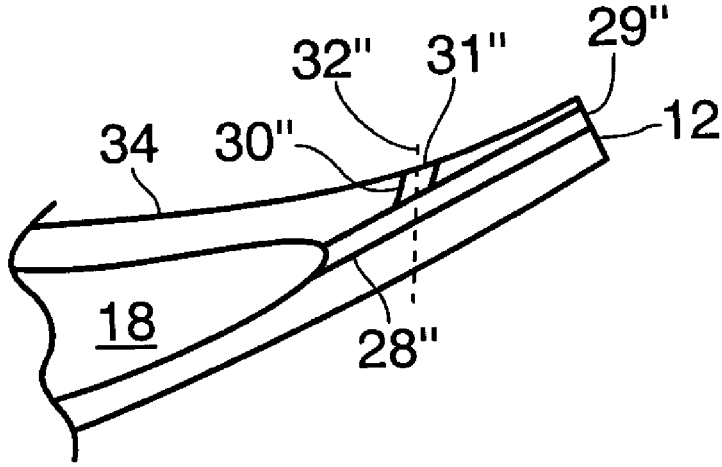
Figure 13:
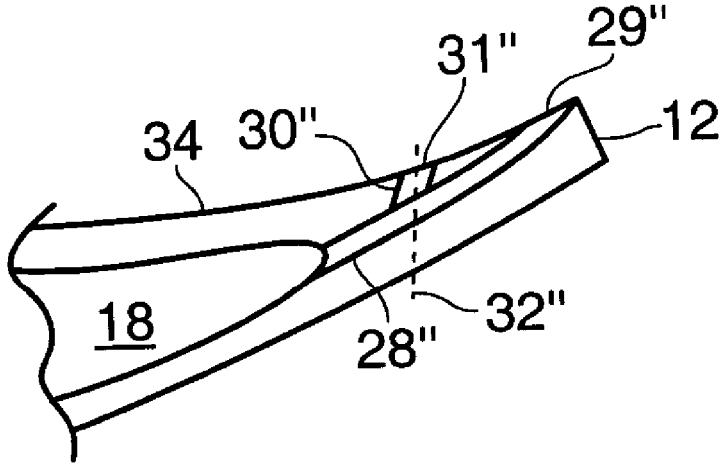

For a better understanding of the present invention, and to show more clearly how it may be carried into effect, reference will now be made, by way of example, to the accompanying drawings, in which:

- FIG. 1A is a cut-away view of a known turbine blade having two cooling air supply passages;
- FIG. 1B is a cut-away view of known turbine blade having a single cooling air supply passage;
- FIG. 2 is a partly sectioned end view of a turbine blade in accordance with the present invention;
- FIG. 3 is a diagrammatic sectional view corresponding to the section indicated by the line III-III in FIG. 2;
- FIG. 4 is a view in the direction of the arrow IV in FIG. 2 and FIG. 3;
- FIG. 5 corresponds to FIG. 4 but shows an alternative embodiment;
- FIG. 6 correspond to FIG. 2 but shows the embodiment of FIG. 5;
- FIGS. 7 and 8 correspond to FIG. 3 but show alternative configurations;
- FIGS. 9 and 10 correspond to FIG. 6 but show alternative embodiments;
- FIG. 11 is a partial perspective view corresponding to FIG. 9 and FIG. 10; and
- FIG. 12 and FIG. 13 correspond to FIG. 6 but show alternative embodiments.

The turbine blade shown in FIG. 1A comprises an airfoil section 2 having a base 4 including a fir tree root 6 at one end and a tip structure 8 at the other end. The airfoil section 2 has a leading edge 10 and a trailing edge 12. Within the blade, there are two cooling arrangements comprising a high pressure supply passage 14 which receives air from the high pressure compressor of the engine to which the blade is fitted. The high pressure supply passage follows a serpentine route within the blade, beginning near the leading edge 10 of the blade, with the air emerging at the surface of the blade through discharge orifices 16.

A low pressure supply passage 18 is provided nearer the trailing edge 12 of the airfoil portion 2. This supply passage receives air from the low pressure compressor of the engine. Cooling air from the low pressure supply passage 18 reaches the exterior of the blade through cooling passages formed in the blade, including cooling passages 20 which extend between the supply passage 18 and discharge openings 22 at the trailing edge of the airfoil portion 2. Other discharge openings 24 are provided in the pressure face of the airfoil portion 2 and 26 at the tip structure 8.

Alternatively, as shown in FIG. 1B, the blade is provided with a single cooling passage 18 which follows a serpentine route within the blade and supplies all the discharge orifices 16, cooling passages 20 and discharge openings 22,24.

FIGS. 2 to 4 show cooling passages 28 and 30 corresponding to the passages 20 of FIG. 1A and FIG. 1B but disposed in accordance with the present invention. As can be appreciated from FIG. 3, the passages 28 are disposed in a first array, and the passages 30 are disposed in a second array. In the specific embodiment shown in FIG. 3, which is also represented in diagrammatic form in FIG. 7, the passages 28 of the first array, are inclined at 45° to the trailing edge 10 of the blade whereas the passages 30 of the second array are inclined at 135° to the trailing edge 10, the angle being measured in the same direction as that of the passages 28 of the first array.

As can be appreciated from FIG. 4, the passages 28, 30 lie in a common plane and the result of this is that the passages 30 intersect the passages 28 at right angles as shown in FIG. 3. At the trailing edge 10 of the blade, the passages 28, 30 open at discharge openings 29, 31 respectively.

It will be appreciated that each passage 28 of the first array extends the full distance from the supply passage 18 to the trailing edge 10, at least over the major part of the airfoil portion 2 of the blade. However, the passages 30 of the second array do not reach the supply passage 18. Instead, they terminate at a position which, as shown in FIG. 3, is approximately halfway between the supply passage and the trailing edge 10. Put another way, there is a first region of the blade adjacent the supply passage 18 that is occupied solely by the passages 28 of the first array. A second region of the blade, extending from the first region to the discharge openings 29, 31, is occupied by passages 28, 30 of both the first and second arrays. The consequence of this arrangement is that, in use, cooling air admitted to the supply passage 18 can reach the cooling passages 30 of the second array only after passing initially through the cooling passages 28 of the first array. At the junctions between the cooling passages 28 and the cooling passages 30, the air flow divides so that air can reach the discharge ports 29 and 31 by many different routes.

Because all of the air flow passes initially along the cooling passages 28, it is the flow cross-section of these passages which determines the overall flow rate of cooling air from the supply passage 18 to the discharge orifices 29, 31. Because the passages 28 can be formed with considerable accuracy, the overall flow rate through the passages 28, 30, and consequently the heat transfer between the material of the blade and the cooling air, can be predicted within close limits.

In an alternative embodiment, as represented diagrammatically in FIGS. 5 and 6, the passages 28' of the first array and the passages 30' of the second array may not be entirely coplanar. As shown in FIG. 6, they are offset so that their centrelines lie in respective planes which are parallel to each other. Nevertheless, the cooling passages 30' still intersect the cooling passages 28' so that, in use, the flow of cooling air between the two remains possible. Although, in the embodiment of FIGS. 5 and 6, the two arrays of cooling passages 28', 30' lie in parallel planes, they could lie in planes which are slightly inclined to each other, provided that each cooling passage 30' intersects, at least partially, at least one of the cooling passages 28'.

FIG. 8 corresponds to FIG. 7, but shows an embodiment in which the cooling passages 30 of the second array extend perpendicular to the trailing edge 10 instead of obliquely, as shown in FIG. 7. It will be appreciated that the cooling passages 28 of the first array may also be oriented at a different angle from that shown in FIG. 7, it being important only that the cooling passages 28, 30 are differently inclined with respect to the trailing edge, so that they intersect. Also, it will be appreciated from FIGS. 3, 7 and 8 that the cooling passages 30, although they stop short of the supply passage 18, are oriented so that their centrelines, exemplified by the centreline 32, when projected, intersect the supply passage 18.

In the embodiments of FIGS. 9 to 11, the discharge openings 29" and 31" emerge on one of the flow surfaces, in this case the pressure face 34, of the air foil portion 2 of the blade. In the embodiment of FIG. 9, the cooling passages 30" of the second array lie in a plane which is parallel to that of the cooling passages 28" of the first array, but lying nearer the pressure face 38. By contrast, in the embodiment of FIG. 10, the cooling passages 30" of the second array lie further from the pressure face 34 than those of the first array.

FIG. 11 shows a diagrammatic perspective view of an embodiment corresponding to FIGS. 9 and 10, illustrating the shape of the discharge openings 29" and 31" as they emerge at the pressure face 34. It will be appreciated that, in this embodiment, the emerging air flows over the pressure face 34 towards the trailing edge 12, so providing film cooling at this region of the blade.

In the embodiment of FIG. 12 the discharge openings 29" and 31" emerge on the trailing edge 12 and pressure face 34 respectively. In the embodiment of FIG. 13 the discharge openings 29" and 31" emerge on the pressure face 34. In both embodiments the cooling passages 30" stop short of the supply passage 18 and their centre lines 32", when projected, do not intersect the supply passage 18. The air emerging from discharge openings 31" shows over the pressure face 34 towards the trailing edge 12, so providing film cooling at this region of the blade.

In use, heat transfer from the material of the blade to the cooling air passing through the passages 28 of the first array is relatively high, but decreases along the cooling passages 28 owing to boundary layer effects. At each intersection between the cooling passages 28 and the cooling passages 30 of the second array, new boundary layers form, and so the heat transfer increases again. Thus, the embodiments described above enable effective heat transfer between the supply passage 18 and the trailing edge 10 (or the discharge openings 29", 31" in the embodiments of FIGS. 9 to 13) while achieving a fixed flow array along the passages 28, 30 regardless of the extent to which the passages 28 and 30 intersect one another.

If the two arrays of cooling passages 28, 30 are not coplanar, the internal area swept by the cooling air increases, so enhancing heat transfer from the blade. For the same reason, such an arrangement results in more metal being removed from the blade to form the cooling passages 28, 30, again enhancing heat removal.

Furthermore, manufacture of the cooling passage arrangement as described above is simpler than for an arrangement in which all of the passages, including passages corresponding to the passages 30 of the second array, open into the supply passage 18.

The invention claimed is:

1. An aerofoil component for a gas turbine engine having a cooling arrangement comprising:

a supply passage within the component;

a plurality of cooling passages comprising a first array of cooling passages and a second array of cooling passages, which open at respective discharge openings at a surface of the component, a first region of the component adjacent the supply passage that is provided with the first array of cooling passages which lie in a common plane, each cooling passage of the first array opening into the supply passage at its end away from its discharge opening, and a second region of the component extending from the first region to the discharge openings comprising the second array of cooling passages which lie in a common plane and the first array of cooling passages, more than one of each of the cooling passages of the second array intersect more than one of the cooling passages of the first array to provide fluid communication between the cooling passages of the first array, each of the cooling passages of the second array terminating short of the supply passage at its end away from its discharge opening at an intersection with the cooling passages of the first array.

2. A component as claimed in claim 1 in which the projected centre lines of at least some of the cooling passages of the second array intersect the supply passage.

3. A component as claimed in claim 1 in which none of the projected centre lines of the cooling passages of the second array intersect the supply passage.

4. A component as claimed in claim 1, in which the cooling passages of the first array and the cooling passages of the second array lie in the same common plane.

5. A component as claimed in claim 1 in which the cooling passages of the first array and the cooling passages of the second array lie in respective different common planes.

6. A component as claimed in claim 5, in which the common planes are parallel to each other.

7. A component as claimed in claim 5, in which the common planes are inclined to each other.

8. A component as claimed in claim 1, in which at least one of the common planes is curved.

9. A component as claimed in claim 1, which is an airfoil component for a gas turbine engine.

10. A component as claimed in claim 9, which is a turbine blade.

11. A turbine blade as claimed in claim 10, in which the discharge openings of the cooling passages of at least one of the arrays are provided at the trailing edge of the turbine blade.

12. A turbine blade as claimed in claim 10, in which the discharge openings of the cooling passages of at least one of the arrays are provided at positions away from the trailing edge of the blade.

13. A turbine blade as claimed in claim 12, in which the discharge openings are situated in a pressure face of the turbine blade.

14. A turbine blade as claimed in claim 10, in which the cooling passages of the first array are disposed at an angle of not less than 30° and not more than 60° with respect to the trailing edge of the turbine blade.

15. A turbine blade as claimed in claim 10, in which the cooling passages of the second array are disposed at angle of not less than 90° and not more than 150° to the trailing edge of the turbine blade.

16. A turbine blade as claimed in claim 15, in which the cooling passages of the second array are disposed at angle of not less 120° and not more than 150° to the trailing edge of the turbine blade.

17. A turbine blade as claimed in claim 10, in which the cooling passages of the second array terminate at a distance from their discharge openings which is not less than ¼ and not more than ¾ of the distance from the discharge openings to the supply passage.

18. A component as claimed in claim 1, in which each of the cooling passages of the first array intersects at least three cooling passages of the second array.

* * * * *